United States Patent [19]

Bhatti

[11] 4,385,764

[45] May 31, 1983

[54] GAME OF STRATEGY DIRECTED TO ENTRAPMENT OF OPPONENT

[76] Inventor: Muhammad A. Bhatti, 317 Knollwood St., Winston-Salem, N.C. 27104

[21] Appl. No.: 302,166

[22] Filed: Sep. 14, 1981

[51] Int. Cl.[3] ..... A63F 3/00

[52] U.S. Cl. ..... 273/243; 273/290

[58] Field of Search ..... 273/242, 260, 255, 258, 273/262, 290, 243

[56] References Cited

U.S. PATENT DOCUMENTS

| | | | |
|---|---|---|---|
| 1,228,091 | 5/1917 | Bradley | 273/260 X |
| 1,315,483 | 9/1919 | Edwards | 273/262 |
| 2,896,950 | 7/1959 | Rosti et al. | 273/258 |
| 3,186,716 | 6/1965 | Shabarick | 273/260 X |
| 3,588,114 | 6/1971 | Vogel | 273/260 |
| 3,761,093 | 9/1973 | Migliore | 273/260 |
| 3,902,724 | 9/1975 | Hersey | 273/258 |
| 3,917,272 | 11/1975 | Aldea | 273/258 X |

FOREIGN PATENT DOCUMENTS

| | | | |
|---|---|---|---|
| 2258881 | 8/1975 | France | 273/288 |

*Primary Examiner*—Richard C. Pinkham
*Assistant Examiner*—Scott L. Brown

[57] ABSTRACT

A game of strategy combining the elements of skill and chance is enacted by two players on a flat, generally square playing surface or board which is divided into a plurality of landing territories. A colored token indicates player movement. A chance device such as a die or dice determines the extent of each move in turn; but the pattern of movement among the territories: i.e. horizontally, vertically or a combination of both, is determined by the player in an exercise of skill with the objective of capturing and occupying territories. A plurality of colored disks are provided each player to indicate a temporarily occupied territory. A plurality of pegs, selectively attached to the colored disks, are used to indicate permanent occupation of territory. The object of the game is to temporarily and/or permanently capture territories in a pattern which will entrap and prevent further movement of the opponent.

5 Claims, 5 Drawing Figures

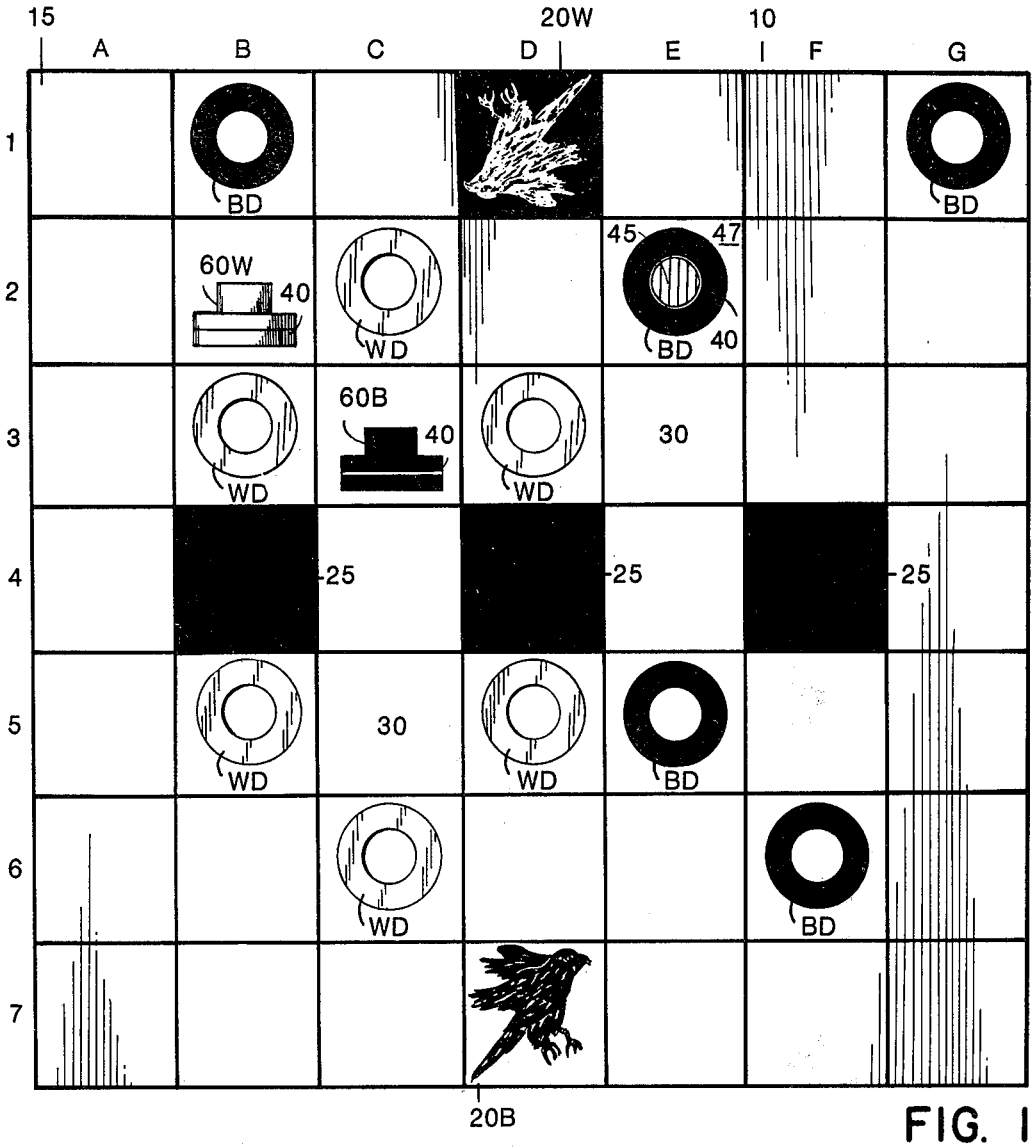
FIG. 1
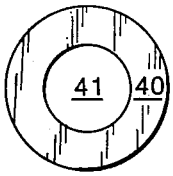
FIG. 2
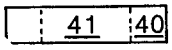
FIG. 3
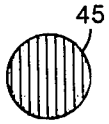
FIG. 4
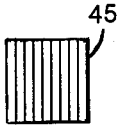
FIG. 5
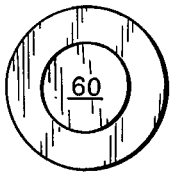
FIG. 6
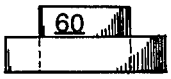
FIG. 7
FIG. 8
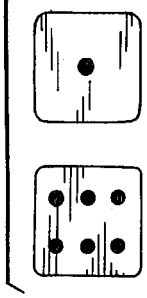

GAME OF STRATEGY DIRECTED TO ENTRAPMENT OF OPPONENT

BACKGROUND OF THE INVENTION

The development of games is a constantly evolving process and successful games frequently are reflective of popular trends in the areas of sports, television shows, finance, political intrigue, and other such subjects. Recently, there has been an increase in interest and demand for strategic games which provide players with an opportunity to utilize the elements of both chance and individual skill to achieve a given end.

The element of chance is desirable as an equalizing effect and to keep the game from becoming boring when played repeatedly. The element of skill is desirable so that players are given the opportunity to exercise choice among certain variables in a game and thereby affect the end result.

It is to the type of game wherein opposing players exercise individual skill, within certain chance controlled limitations, to outwit each other strategically that the present invention is directed.

SUMMARY OF THE PRESENT INVENTION

The apparatus described herein is directed to a board game in which the objective is to trap an opponent and prevent his further movement. The objective is reached by capturing a series of landing areas or territories on the playing surface. The captured territories must be strategically located such that they surround the opponent and act as a barrier to his further movement.

The game is enacted on a flat playing board, the surface of which is divided into a plurality of squares preferably arranged in a pattern of columns and rows. Each of the squares has a specifically defined function, for example, a player starting point, a barrier territory or an initially available landing territory. There are two player starting points, or home squares, located on opposing edges of the playing surface.

The barrier territories constitute islands which a player may neither move over nor land on. In number these areas preferably comprise between 5% and 10% of the total number of squares on the playing surface (3 in the preferred embodiment). They are spaced intermediately of the player home squares, preferably in the center row of the playing surface.

The remainder of the playing surface is made up of squares constituting player landing areas or territories. In number these landing areas equal approximately 85% to 90% of the total number of squares (44 in the preferred embodiment); and any one may be passed over, landed on, captured and temporarily or permanently occupied during the course of the game.

A token of a different color is provided each player to indicate movement across the board. The extent or number of spaces a player moves during a given turn is determined by a chance device such as dice. A player rolls a die and moves, according to the number upturned on the die, that number of squares in a path determined by individual skill and strategy within the given rules of the game. The path of movement may be horizontal or vertical, or a combination thereof. The movement may be diagonal only if the path of movement involves the home square. A player may not contact the same territory or square more than once during a single move, and a player may not move over or land on the barrier islands, the opponent's home square, or a territory which has been captured and permanently occupied by the opponent.

Players may not move over a territory which is temporarily occupied by the opponent's token. However, a player may land on a temporarily occupied territory, recapture and evict the opponent, if that territory constitutes the last square within the individual player move.

Occupation of a territory is indicated by an individual disk if the occupation is temporary, and by a disk in combination with a peg if the occupation is permanent. Each player is provided with a plurality of individual disks, one of which is placed on the last square of each move, under the player token and covered thereby as to be invisible. The player's next move begins from that square, leaving the disk in place to indicate temporary occupation. As stated above, a player may not pass over a territory having an opponent's disk thereon. However, if that territory is the last square or step within the player's move as determined by the die, the player may land there, evict the opponent's disk, and take temporary occupation of the territory himself.

Permanent occupation of a territory occurs when a player can land on a territory having the opponent's token thereon. When this occurs, the player may then move his own token to any territory which he temporarily occupies and place a peg within the disk thereon to indicate his permanent occupation of that territory. The pegged disk will stay on that square or territory for the remainder of the game and the opponent cannot pass over or land on that territory. The player places his token on the pegged disk and begins his next move from that point.

When a player has utilized the last available peg, each player has a specified number of moves remaining to complete the game (seven in a preferred embodiment) by forcing his opponent into a position where he cannot make his next move. If neither player has won the game by trapping the opponent within the seven moves, neither wins the game. Therefore, it is possible for both players to lose the game.

It is therefore an object of the present invention to provide a board game of strategy employing the elements of both chance and skill, wherein one player attempts to trap the opposing player and prevent his further movement.

The objects of the game and possible modifications thereto will become apparent as the description of a preferred embodiment is studied in conjunction with the accompanying drawing in which:

FIG. 1 is a plan view of the playing surface, according to a preferred embodiment, during an intermediate period in the progress of a game;

FIG. 2 is a top plan view of a players disk;

FIG. 3 is a side view of a player's disk;

FIG. 4 a top view of a peg which may be placed in a disk;

FIG. 5 is a side view of a peg;

FIG. 6 is a top view of a player's token;

FIG. 7 is a side view of a player's token; and

FIG. 8 shows two side of a chance selecting device.

DETAILED DESCRIPTION OF PREFERRED EMBODIMENT

The following description is directed to a preferred embodiment of the playing surface and playing pieces associated with the strategic game according to the present invention. Preferably the game is played by two persons, the objective of each being to entrap the other strategically so that he cannot make a further move.

As illustrated the playing surface comprises a flat playing board 10 divided into a plurality of squares 15. In this preferred embodiment the board 10 is divided into forty-nine equal squares 15 in seven columns A-G and seven rows 1–7 across the surface of the board. Each of the squares 15 has one of three specifically defined functions, either a home square, a barrier square or a neutral landing zone. A player starting point or home square 20W, 20B is specified on opposing sides of the playing surface 10. It is preferred that each of the starting points 20W and 20B be colored differently or otherwise distinguished as, for example, by a figure or its negative or mirror image. For purposes of illustration only, starting point 20W is designated to the descriptive "white" player and 20B to the "black" player. Islands or barriers 25 are placed at spaced points along a middle row 4. A player may not move over or land on either of the barriers 25 at any time during the course of a game. It is preferred that the islands 25 be made readily distinct for quick identification during play. Although not limited to such, it is preferred that the islands 25 be colored black or some other dark color, distinct from all other colors used over the board, for this purpose. The remaining forty-four squares 15 are designated neutral landing zones or territories 30. During the course of a game a player may take temporary or permanent control or occupation of these neutral territories 30 (by means described below) in a strategic arrangement which will subsequently trap the opponent and prevent his further movement.

Each participant is given a plurality of colored disks 40 ("white" player receives white disks and "black" player, black disks) for use in indicating that a given neutral territory 30 is temporarily occupied by one of the players. Disks 40 may have any peripheral configuration as this is not critical. A central hollow or aperture 41 is provided for receiving a peg 45 as described hereinbelow. The number of disks 40 provided each player should be approximately equal to half the number of territories 30 on the playing surface 10.

A specified plurality of pegs 45 (preferably five) which are selectively and at times discretely emplaced on disks 40 are also provided. When a player has permanently occupied a given territory 30, according to the rules of the game to be described hereinbelow, one of the pegs 45 is emplaced within the player's individual disk 40 for the duration of the game. When a pegged disk as indicated at 47 on board 10, is in place on a territory 30, the opposing player may neither move over or land on that territory for the duration of the game. In a preferred embodiment the peg 45 is of a peculiar shape (round, square, etc.) which snaps or snugly fits into the correspondingly shaped hollow or aperture 41 in the center of disk 40. Additionally the depth of peg 45 is, in a preferred embodiment, equal to less than or more than the corresponding depth of disk 40 so that when the token 60 (to be later described) is placed atop the disk 40, the peg 45 is hidden. The reasons for this are discussed later.

The token 60 may be of any shape, the only critical feature being that when placed on a pegged disk 45, the token hides or masks the disk. Where the peg does not protrude above the surface of the disk 40, it is only necessary that the token 60 have a relatively flat bottom and a diameter greater than that of the peg 45. Alternatively, the token 60 might have a hollow bottom and fit down over the entire disk 40 and peg 45 should the peg be of a depth greater than that of the disk, thus hiding the entire disk/peg assembly.

To determine the number of squares or territories 30 over which a player's token is to be moved during a turn of the play, each player is given a single die 50 which is rolled at the beginning of each turn. Alternately, the same die may be alternatively used by the players turn by turn. It should be stated, however, that any chance controlled numerical indicator may be used rather than dice. For example, an hourglass tube closed at both ends, made up of transparent material, that has a plurality of balls that may be shaken up and down with the tube so that a number of them ultimately are lodged in a specified compartment of the tube, may be used.

Play is instigated with the white and black tokens 40 on the white and black home squares 20W and 20B in front of the respective players. The player taking the first turn may be selected by any mutually agreeable method such as a roll of the dice, coin toss, etc. After the first player is chosen, that first player rolls one of the die and moves his token 50 the number of squares or territories 30 indicated on the upturned die. Movement out of the home square 20 (in any turn) may be diagonal, horizontal or vertical. However, from territories other than the home square player movement may be only horizontal or vertical. Each move may be a combination of horizontal and vertical (or diagonal if the path of movement includes the home square.)

The first player moves the required number of territories 30, and places his individual disk 40 on the territory or segment upon which his move terminates. The opposing player then takes the next turn in the same manner and places his individual disk 40 in the last territory of his move. The players' tokens are left on top of the respective player disks and the third and fourth turns are begun from those territories.

Referring now to FIG. 1 of the drawing, the characters BD refer to black player disks and territories which are temporarily occupied by the "black" player. Likewise, the characters WD refer to territories temporarily occupied by the "white" player. The characters 60W and 60B refer to respective "white" and "black" player tokens.

Assume the territories as indicated have been captured and occupied during the course of the game. As previously mentioned a player cannot move over or land on: the barriers 25, the opposing home square 20, or a square or territory 30 having the opposing pegged disk on it. Further a player cannot move over a territory have the opponent's unpegged disk 40 thereon, but may land on such a territory if it is the last square of a move.

If a player terminates his move on a territory 30 occupied by the opponent's unpegged disk 40, he evicts the opponent and occupies it with his own disk 40. If a player terminates his move on a territory 30 occupied by the opponent's unpegged disk 40 and token 60, he moves his own token 60 to any territory he temporarily occupies and inserts a peg 45 through the aperture 41 of the disk 40 thereon, to indicate his permanent possession of that territory 47. The pegged disk stays in its place for the remainder of the game. The player places his token 60 on the pegged disk 47 and begins his next move from that point.

A player may terminate his move at a point (as determined by the rules of the game) that he occupied during a previous turn but may not contact the same point more than once during his current turn. Thus, a player's token may be resting, at any point in a game, on an unpegged disk 40 or a pegged disk 47. The form, size and structure of the disk, the peg and the token is such as to make it impossible to tell if a token 60 is resting on an unpegged disk 40 or a pegged disk 47, merely by the sight. One is thus expected to rely entirely upon one's memory of the past events, enhancing the challenge of the game.

If a player passes over or lands on the opponent's pegged disk 47 (even if the peg is hidden by token 40), one of the barrier islands 25, or the opponent's home square 20, he is penalized by losing that turn. Completion of a move to the last point necessitates the penalty.

Therefore, at this point in the game assume it is the "black" player's turn. If the "black" player rolls the die and the numeral one is upturned, he may move the token 60B one square down to the empty square, or up, left, or right to a territory having one of the unpegged white disks WD on it. If two is upturned on the die, "black" player may only move the token 60B down two squares. If the die turns up a three the "black" player may only move down two squares and then either to the right or left one square to a territory having an unpegged white disk WD on it; or the "black" player may move straight down three squares. If the die turns up a four, five or six the "black" player is trapped because he cannot move his token 60B over the barriers 25 or over territories 30 having white disks thereon. Therefore, in this instance the "black" player has lost the game. If none of the players is able to trap the opponent before seven turns have elapsed after all pegs are used, then both players lose the game.

The colors and shape of the playing pieces as described herein are for illustrative purposes only.

It will be obvious to those skilled in the art that modifications may be made within the scope of the invention which is limited only by the following claims.

What is claimed is:

1. A game of strategy comprising:

(a) a playing board divided into a plurality of squares each square being one of three types, the three types including:
  (i) two home squares; each positioned on opposite sides of said playing surface;
  (ii) a first plurality of barrier squares comprising a minor portion of the total number of said squares and positioned intermediately of said home squares;
  (iii) a second plurality of neutral player landing areas comprising a major portion of the total number of said squares;

(b) one token per player to indicate player movement along said playing surface;

(c) a plurality of disks, one-half of said plurality being designated to each player and utilized one at a time to indicate temporary player possession of one of said landing areas;

(d) a plurality of pegs and means for temporarily assembling each of said pegs within said disks to alter said disks to indicate permanent player possession of one of said landing areas;

(e) said tokens having means for masking the presence or absence of a peg within a disk at times when a token is placed atop a disk;

(f) a chance device for determining scope of player movement.

2. The game according to claim 1 wherein said plurality of squares on said game board is arranged in a rectangular pattern of seven rows and seven columns, giving a total of forty-nine squares.

3. The game according to claim 2 wherein said barrier squares are three in number spaced along the middle row of said seven row pattern.

4. The game according to claim 1 wherein said masking is accomplished by said pegs being of such depth as to fit in the combined hollow of the disk with the token placed upon it.

5. The game according to claim 1 whereby the objective of trapping the opponent is achieved by a combination of chance, skill and memory.

* * * * *